US008749441B2

(12) United States Patent
Fenn et al.

(10) Patent No.: US 8,749,441 B2
(45) Date of Patent: Jun. 10, 2014

(54) SIMULTANEOUS TRANSMIT AND RECEIVE ANTENNA SYSTEM

(75) Inventors: Alan J. Fenn, Wayland, MA (US); Peter T. Hurst, Cambridge, MA (US); Jeffrey S. Herd, Rowley, MA (US); Kenneth E. Kolodziej, Lexington, MA (US); Leonard I. Parad, Acton, MA (US); Hans Steyskal, Concord, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 418 days.

(21) Appl. No.: 13/282,700

(22) Filed: Oct. 27, 2011

(65) Prior Publication Data

US 2013/0106667 A1 May 2, 2013

(51) Int. Cl.
*H01Q 9/16* (2006.01)

(52) U.S. Cl.
USPC ..... 343/793; 343/844

(58) Field of Classification Search
USPC ..... 343/793, 844
See application file for complete search history.

(56) References Cited

U.S. PATENT DOCUMENTS

| | | | | |
|---|---|---|---|---|
| 4,555,708 | A | 11/1985 | Waineo et al. | |
| 5,038,151 | A | 8/1991 | Kaminski | |
| 5,264,862 | A | 11/1993 | Kumpfbeck | |
| 5,838,282 | A * | 11/1998 | Lalezari et al. | 343/727 |
| 6,147,657 | A * | 11/2000 | Hildebrand et al. | 343/844 |
| 6,369,770 | B1 | 4/2002 | Gothard | |
| 7,176,844 | B2 * | 2/2007 | Chiang et al. | 343/815 |
| 7,498,989 | B1 * | 3/2009 | Volman | 343/700 MS |
| 2005/0052330 | A1 | 3/2005 | Mehltretter | |

FOREIGN PATENT DOCUMENTS

| | | | |
|---|---|---|---|
| JP | 2002-016427 | A | 1/2002 |
| KR | 10-2010-0070555 | A | 6/2010 |

OTHER PUBLICATIONS

International Search Report and Written Opinion in counterpart international application No. PCT/US2011/057999, mailed on Nov. 12, 2012; 10 pages.

A.W. Rudge, Handbook of Antenna Design, Peter Peregrinus Ltd, 1983, vol. 2, pp. 305-329.

B.A. Chiang, "A Study of Communication Antenna Isolation", Final Report FAA-RD-73-94, Howard University, Washington, DC, Jun. 1973, AD768848.

(Continued)

*Primary Examiner* — Tan Ho

(74) *Attorney, Agent, or Firm* — Schmeiser, Olsen & Watts LLP; William G. Guerin

(57) ABSTRACT

Described is a simultaneous transmit and receive antenna system having a ring array of transmit antenna elements and a receive antenna element disposed on an axis that is perpendicular to and passing through the center of the ring array. Alternatively, the ring array includes receive elements and a transmit antenna element is disposed on the axis perpendicular to the ring array. Opposite antenna elements in the ring array differ in phase by 180° so that a radiation pattern null occurs at the antenna element at the center of the ring array. Also included are at least one ground plane and an electrically-conductive cylinder disposed on the perpendicular axis inside the ring array to provide a high degree of isolation between the transmit and receive antenna elements. The system may be configured for wireless communications, for example, according to WIFI IEEE standard 802.11 or WIMAX IEEE standard 802.16.

34 Claims, 14 Drawing Sheets

(56) References Cited

OTHER PUBLICATIONS

A.J. Fenn, "Theoretical and Experimental Study of Monopole Phased Array Antennas," IEEE Trans. Antennas Propagat., vol. AP-34, No. 10, pp. 1118-1126, Oct. 1985.

R.G. Kouyoumjian and P.H. Pathak, "A Uniform Theory of Diffraction for an Edge in a Perfectly Conducting Surface", Proc. IEE, vol. 62, No. 11, 1974, pp. 1448-1461.

A. Alford and A.G. Kandoian, "Ultrahigh-Frequency Loop Antennas", AIEE Transactions, vol. 59, 1940, pp. 843-848.

A.J. Fenn, "Arrays of Horizontally Polarized Loop-Fed Slotted Cylinder Antennas," IEEE Trans. Antennas Propagat., vol. AP-33, No. 4, Apr. 1985, pp. 375-382.

J.D. Kraus, "Antennas", 2nd Edition, McGraw-Hill, Inc.,1988, pp. 353-358.

* cited by examiner

SIMULTANEOUS TRANSMIT AND RECEIVE ANTENNA SYSTEM

GOVERNMENT RIGHTS IN THE INVENTION

This invention was made with government support under grant number FA8721-05-C-0002 awarded by the Air Force. The government has certain rights in this invention.

FIELD OF THE INVENTION

The present invention relates generally to an antenna system having simultaneous transmit and receive capability. More particularly, the invention relates to a system for full duplex wireless communications having a transmit ring array antenna and a central receive antenna.

BACKGROUND OF THE INVENTION

Various antenna configurations have been used for simultaneous transmit and receive (STAR) applications with omnidirectional pattern coverage. For example, a ring array antenna having a linear phase progression with increasing angle around the array circumference can be used to produce the omnidirectional radiation pattern. For an even number of antenna elements in the ring array, each opposing pair of antenna elements is fed anti-phase, that is, the two antenna elements differ in phase by 180°, to generate a radiation pattern having a null at the center of the ring array.

Ring array antennas are capable of full duplex operation wherein the antenna can transmit and receive simultaneously in the same frequency band. These ring array antennas have a substantially omnidirectional pattern in the azimuth plane for both transmit and receive operations. The receive antenna includes four antenna elements each having a beamwidth in the azimuth plane that is slightly greater than 90°. The receive antenna elements are arranged symmetrically about a midpoint that lies in the azimuth plane. The receive beams of the four receive antenna elements face outward, that is, away from the midpoint, and together the receive beams cover the full azimuth plane. The transmit antenna is a colinear set of dipole elements that is orthogonal to the azimuth plane and centered on the midpoint of the receive array. A nulling circuit connected to the receive array provides further isolation between transmit and receive operations by imposing a 180° phase difference between geometrically opposite receive antennas. Adjacent antenna elements in the four-element receive array are offset in phase by 90°.

A high-isolation ring array antenna system with collocated antennas and cancellation of coupled signals for simultaneous transmit and receive has been developed. In this system, a vertical transmit dipole antenna is mounted on top of a mast and an array of vertical receive dipole antenna elements is supported on the mast below the transmit vertical dipole antenna. The receive dipole antenna elements are arranged in pairs wherein one of the elements in the pair is located on the opposite side of the mast from the other element in the pair. The receive dipole antenna elements are symmetrically located in the omnidirectional antenna pattern of the transmit dipole antenna. The coupling to each receive dipole antenna element is equal and in-phase with respect to the coupling for each of the other receive dipole antenna elements. The total coupling is effectively zero due to the antiphase combination of signals from the two receive dipole antenna elements in each pair of opposing elements. By reciprocity, cancellation of coupled signals is also achieved when the vertical transmit dipole antenna element is instead used to receive and when the array of receive dipole antenna elements is instead used to transmit. Dipole and monopole high-isolation antenna systems can also be configured on ground planes. For a four-element array, the phasing for a progressive phase variation is 0°, 90°, 180° and 270°. By way of example, measured isolation data on the order of 60 dB for a dipole array antenna system that operates in the 30 to 88 MHz band has been acquired.

A dipole ring array antenna system for generating circularly polarized radiation patterns having a null on axis has been developed. Opposing antenna elements in the ring array are driven so that their electrical phases differ by 180°. For an eight element dipole array, the relative phasing along the circumference of the array is a so-called third mode, that is, the phase variation moving along the ring array is 0°, 225°, 90°, 315°, 180°, 45°, 270° and 135° degrees which yields circular polarization for horizontally-oriented dipole antenna elements.

A ring array of four progressively phased (0°, 90°, 180° and 270°) dipole antenna elements and a central dipole for improved isolation has been studied. In particular, geometries in which the central dipole is at the same height and elevated above the ring array were analyzed. The elevated dipole geometry was shown to increase isolation by 3 dB.

SUMMARY

In one aspect, the invention features a STAR antenna system that includes a ring array of transmit antenna elements, a ground plane, an electrically-conductive cylinder, a top ground plane and a receive antenna element. The transmit antenna elements are equally angularly distributed about a ring axis. Each of the transmit antenna elements has a phase relative to the phase of the other transmit antenna elements wherein the phases increase linearly according to an angular position in the ring array and wherein the phases for an opposite pair of transmit antenna elements differ by 180 degrees. The ground plane is disposed under the ring array of transmit antenna elements and the electrically-conductive cylinder is disposed on the ring axis above the ground plane. The top ground plane is disposed at an end of the electrically-conductive cylinder that is opposite the ground plane. The receive antenna element is disposed on the ring axis above the electrically-conductive cylinder and top ground plane so that a path between each transmit antenna element and the receive antenna element is at least partially obscured by at least one of the electrically-conductive cylinder and the top ground plane to thereby increase isolation between the transmit antenna elements and the receive antenna element. In some embodiments, the transmit antenna elements are instead receive antenna elements and the receive antenna element is instead a transmit antenna element.

In another aspect the invention features a STAR antenna system that includes a ring array of transmit antenna elements, a ground plane and a receive antenna element. The transmit antenna elements are equally angularly distributed about a ring axis and each transmit antenna element has a phase relative to the phases of the other transmit antenna elements. The phases increase linearly according to an angular position in the ring array and the phases for an opposite pair of transmit antenna elements differ by 180 degrees. In some embodiments, the transmit antenna elements are instead receive antenna elements and the receive antenna element is instead a transmit antenna element.

In another aspect the invention features a STAR antenna system that includes a ring array of transmit antenna elements, an electrically-conductive cylinder, a first ground plane, a second ground plane and a ring array of receive antenna elements. The transmit antenna elements are equally angularly distributed about a ring axis and each transmit antenna element has a phase relative to the phases of the other transmit antenna elements. The phases increase linearly according to an angular position in the ring array of transmit antenna elements and the phases for an opposite pair of transmit antenna elements differ by 180 degrees. The first ground plane is disposed under the ring array of transmit antenna elements and the electrically-conductive cylinder is disposed on the ring axis above the first ground plane. The second ground plane is disposed at an end of the electrically-conductive cylinder that is opposite the first ground plane. The receive antenna elements are equally angularly distributed about the ring axis above the second ground plane. Each of the receive antenna elements has a phase relative to the phases of the other receive antenna elements. The phases increase linearly according to an angular position in the ring array of receive antenna elements and the phases for an opposite pair of receive antenna elements differ by 180 degrees. In some embodiments, the transmit antenna elements are instead receive antenna elements and the receive antenna elements are instead transmit antenna elements.

In another aspect the invention features a STAR antenna system that includes an upper truncated conical section having an electrically-conductive surface, a lower truncated conical section having an electrically-conductive surface, and a ring array of transmit antenna elements equally angularly distributed about a ring axis and disposed between the upper and lower truncated conical sections. Each of the transmit antenna elements has a phase relative to the phases of the other transmit antenna elements. The phases increase linearly according to an angular position in the ring array and the phases for an opposite pair of transmit antenna elements differ by 180 degrees. The STAR antenna system also includes an electrically-conductive cylinder disposed above the upper truncated conical section, a top ground plane disposed at an end of the electrically-conductive cylinder that is opposite the upper truncated conical section, and a conical receive antenna element disposed on the ring axis above the top ground plane. In some embodiments, the transmit antenna elements are instead receive antenna elements and the conical receive antenna element is instead a conical transmit antenna element.

In yet another aspect, the invention features a STAR antenna system that includes an upper truncated conical section having an electrically-conductive surface, a lower truncated conical section having an electrically-conductive surface, and a ring array of transmit antenna elements equally angularly distributed about a ring axis and disposed between the upper and lower truncated conical sections. Each of the transmit antenna elements has a phase relative to the phases of the other transmit antenna elements. The phases increase linearly according to an angular position in the ring array and the phases for an opposite pair of transmit antenna elements differ by 180 degrees. The STAR antenna system also includes a lower conical section having an electrically-conductive surface and being disposed above the upper truncated conical section, an upper conical section having an electrically-conductive surface and being disposed above the lower conical section, and a receive antenna element disposed between the lower and upper conical sections. In some embodiments, the transmit antenna elements are instead receive antenna elements and the receive antenna element is instead a transmit antenna element.

BRIEF DESCRIPTION OF THE DRAWINGS

The above and further advantages of this invention may be better understood by referring to the following description in conjunction with the accompanying drawings, in which like numerals indicate like structural elements and features in the various figures. For clarity, not every element may be labeled in every figure. The drawings are not necessarily to scale, emphasis instead being placed upon illustrating the principles of the invention.

DETAILED DESCRIPTION

In brief overview, the invention relates to a STAR antenna system having a ring array of transmit antenna elements and a receive antenna element disposed on an axis that is perpendicular to and passing through the center of the ring array. Alternatively, the ring array includes receive elements and a transmit antenna element is disposed on the axis perpendicular to the ring array. Opposite antenna elements in the ring array differ in phase by 180° so that a radiation pattern null occurs at the central antenna element. The STAR antenna system also includes one or more ground planes and an electrically-conductive cylinder disposed on the perpendicular axis inside the ring array. Geometrical parameters of the ground planes and electrically-conductive cylinder are chosen to further improve isolation between the transmit and receive antenna elements. Alternative configurations of the STAR antenna system allow for wideband operation. Applications of the STAR antenna system include reception and transmission of microwave signals (e.g., signals in 400 to 5800 MHz frequency range) for radar and wireless telecommunications. Other applications include mobile telephone (453 MHz to 468 MHz), analog cellular telephone (824 MHz to 960 MHz), digital cellular telephone (824 MHz to 1880 MHz) and personal communications systems (1850 MHz to 1990 MHz), WiFi (2400 MHz to 2500 MHz and 5100 MHz to 5800 MHz) according to the IEEE 802.11 standard for implementing wireless local area network (WLAN) computer communications, WiMAX (2400 MHz to 2500 MHz, 3400 MHz to 3500 MHz and 5100 to 5800 MHz) according to the IEEE 802.16 standard for implementing wireless communications over a long range distance, and Long-Term Evolution (LTE) wireless communications (700 MHz to 3600 MHz). Various embodiments of the STAR antenna system are adapted for installation on towers, in buildings and on vehicles such as ground vehicles, aircraft and satellites. Other embodiments are adapted for applications in handheld devices and backpack antenna applications.

Figure 1:
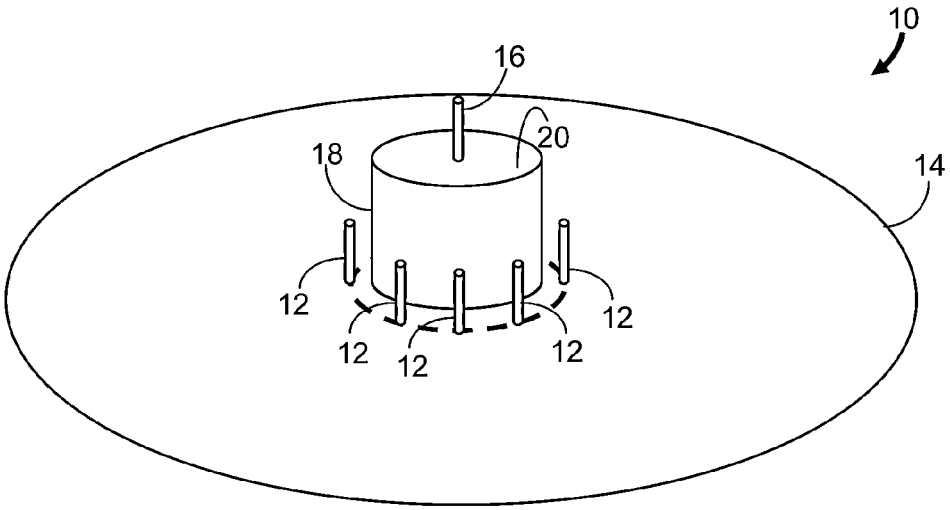
FIG. 1 is an illustration of an STAR antenna system according to an embodiment of the invention.
Figure 2:
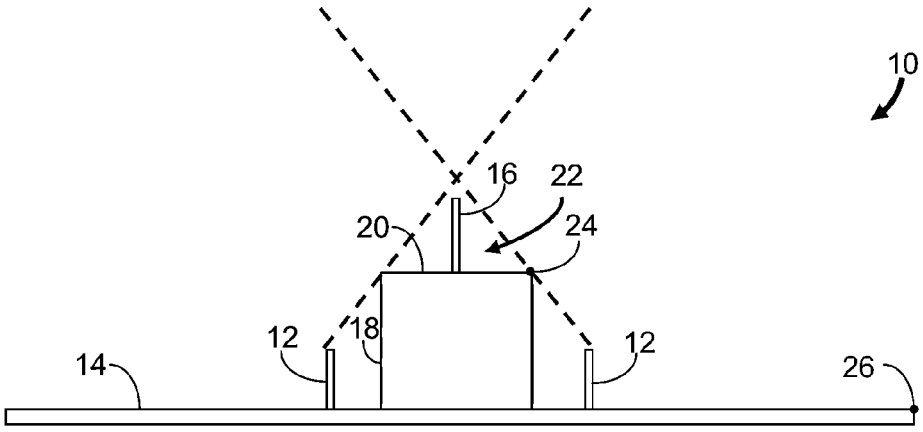
FIG. 2 is a side view of the STAR antenna system of FIG. 1.

FIG. 1 shows one preferred embodiment of an antenna system 10 for simultaneous transmit and receive (STAR) operation. The system 10 includes a vertically-polarized transmit monopole ring array comprising monopole antenna elements 12 disposed over a circular bottom ground plane 14 and a central vertically-polarized receive monopole antenna 16 disposed over a central electrically-conductive cylinder 18 and circular top ground plane 20. It will be understood that all antenna elements shown in FIG. 1 and subsequent figures are electrically separate from nearby ground planes and other conductive features unless otherwise stated. In the illustrated embodiment, the receive monopole 16 does not have a direct line of sight to any of the transmit monopoles 12. Instead, the receive monopole 16 is located in the shadow region 22 with respect to the transmit monopoles 12 as depicted in a side view of the antenna system 10 shown in FIG. 2. Thus the mutual coupling between the transmit monopoles 12 and the receive monopole 16 is due to edge diffraction, for example, from the cylinder edge 24 and bottom ground plane edge 26. Relative to direct line of sight coupling, edge diffraction is a weak coupling effect and therefore the illustrated system 10 achieves the desired high isolation.

Figure 3:
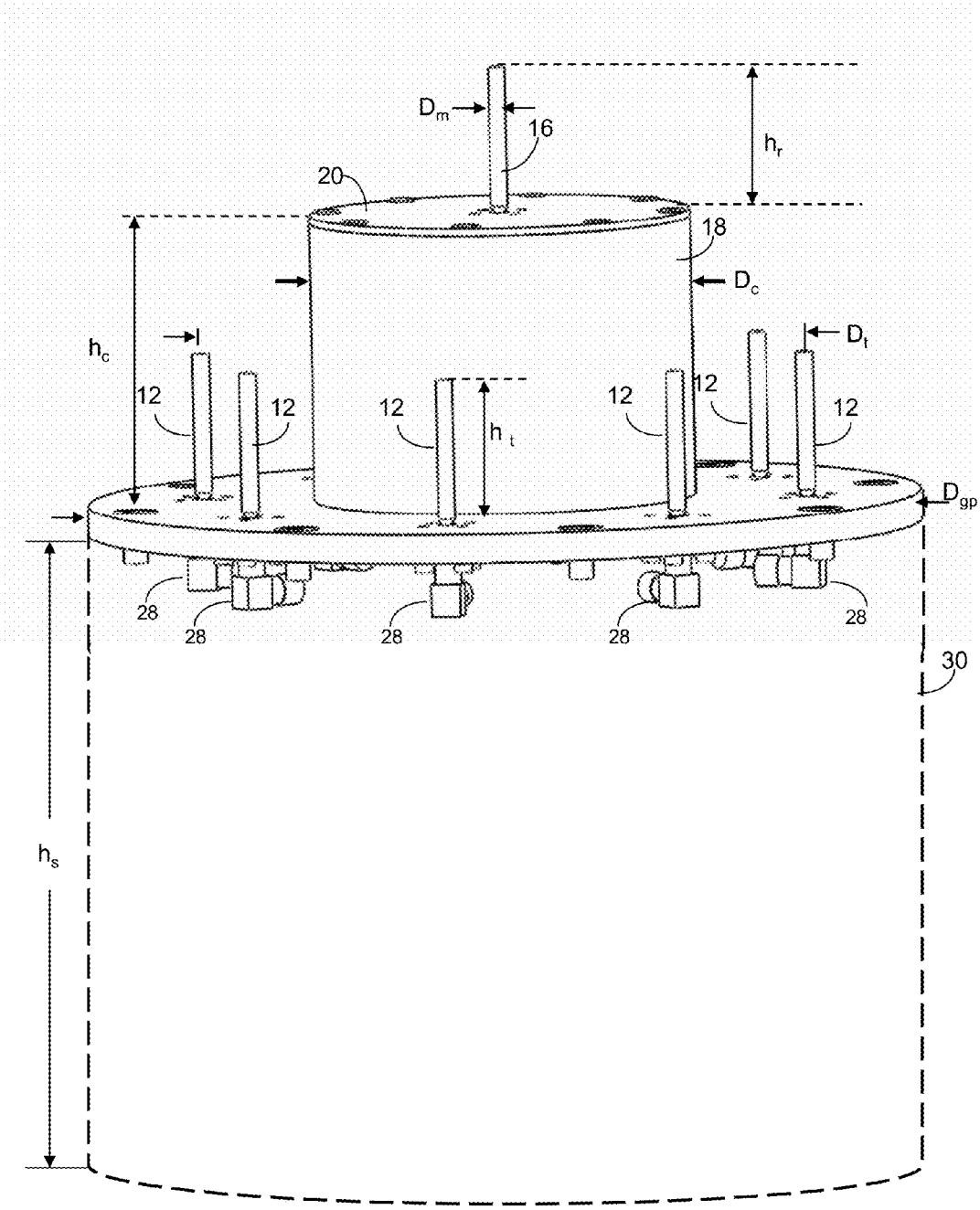
FIG. 3 is a more detailed view of the STAR antenna system of FIG. 1.

FIG. 3 is a more detailed view of the STAR antenna system 10 of FIG. 1 and includes references to various geometrical parameters. In a preferred embodiment, the spacing between neighboring transmit monopoles 12 is approximately one-half wavelength at the center operating frequency so that the transmit monopoles 12 can be phased for omnidirectional azimuth pattern coverage. Thus for an eight-element transmit monopole ring array as shown in FIG. 3, the array circumference is approximately four wavelengths at the center operating frequency and the diameter $D_t$ of the transmit ring array is about=1.27 wavelengths. For an operating frequency range of 2.4 to 2.5 GHz (e.g., the Wi-Fi band and one of the industrial, scientific and medical (ISM) bands with a 2.45 GHz center frequency) the transmit ring array diameter $D_t$ is approximately 16 cm. For resonance, the lengths $h_t$ and $h_r$ of the transmit monopole antenna elements 12 and receive monopole antenna element 16, respectively, are one-quarter wavelength. Thus the length of each monopole $h_t$ or $h_r$ is approximately 3 cm for the 2.45 GHz center frequency. The monopole antenna elements 12 and 16 can be formed from a variety of electrically-conductive materials, including metals such as brass or copper. The diameter $D_m$ of each monopole element 12 or 16 is approximately 0.32 cm and is electrically-coupled through a microwave connector 28 having a center pin that extends through a hole in the ground plane 14. The microwave connectors 28 can be either right-angle connectors or straight-type connectors. A cylindrical metallic shield 30 maintains circular symmetry and encloses the connectors 28, coaxial cables and beamformer elements to prevent electromagnetic scattering.

The conductive cylinder 18 acts as a vertical ground plane for the transmit monopoles 12 and is located approximately one-quarter wavelength away from each transmit monopole 12. In the preferred embodiment, a 180° phase shift is imparted to the vertically polarized electric field generated by the transmit monopoles 12 upon reflection from the conductive cylinder 18. The one-quarter wavelength distance between the transmit monopoles 12 and the conductive cylinder 18 introduces a 90° phase shift in the electric field, such that the total phase shift is 360° for the field that propagates from each transmit monopole 12 to the conductive cylinder 18 and back to the transmit monopole 12. Thus at 2.45 GHz the central conductive cylinder has a diameter $D_c$ of 9.43 cm which is one-half wavelength less than the diameter $D_t$ of the transmit ring array and the fields radiated from the transmit monopoles 12 are effectively increased. Due to the presence of the central electrically conductive cylindrical ground surface 18, the transmit monopoles 12 that normally exhibit an omnidirectional radiation for free space propagation instead have a directional radiation pattern with a peak transmission occurring at the azimuth positions of the transmit monopoles 12.

Figure 4:
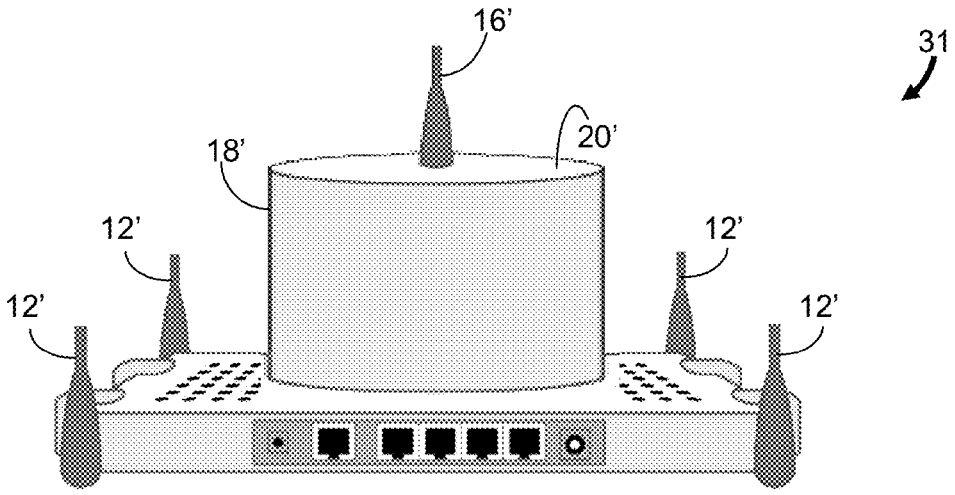
FIG. 4 is an illustration of a WiFi router configured with a STAR antenna system according to an embodiment of the invention.

FIG. 4 shows a WiFi router 31 configured with a STAR antenna system that is configured similarly to the system 10 of FIGS. 1 and 3; however, only four transmit monopoles 12' are used. For example, the router 31 may be configured for wireless communications according to WIFI IEEE standard 802.11 or WIMAX IEEE standard 802.16. In the illustrated embodiment, there are no line of sight paths between the transmit monopoles 12' and the receive monopole 16. In other embodiments there can be a partial line of sight between the transmit monopoles 12' and the receive monopole 16' where acceptable STAR isolation is achieved.

Figure 5:
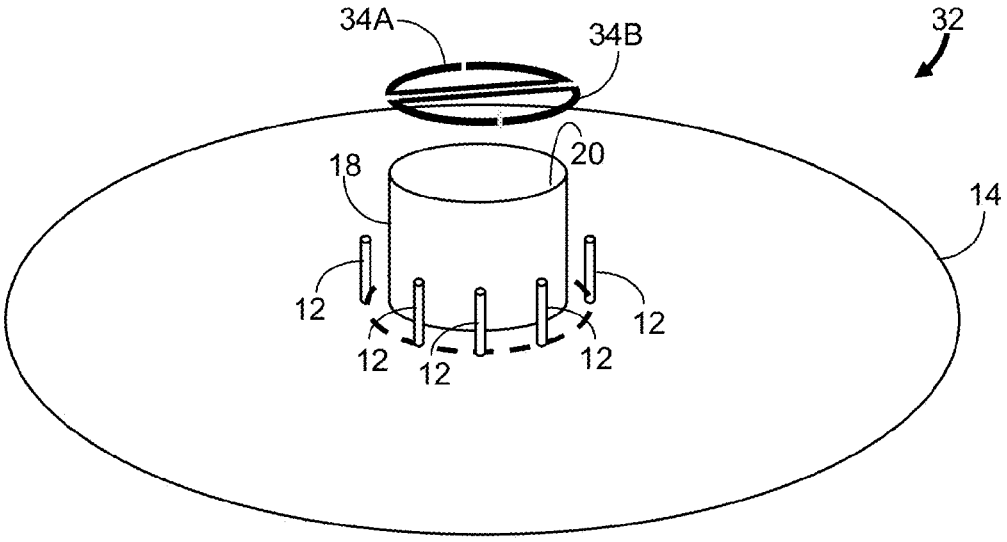
FIG. 5 is an illustration of another embodiment of a STAR antenna system according to the invention.
Figure 6:
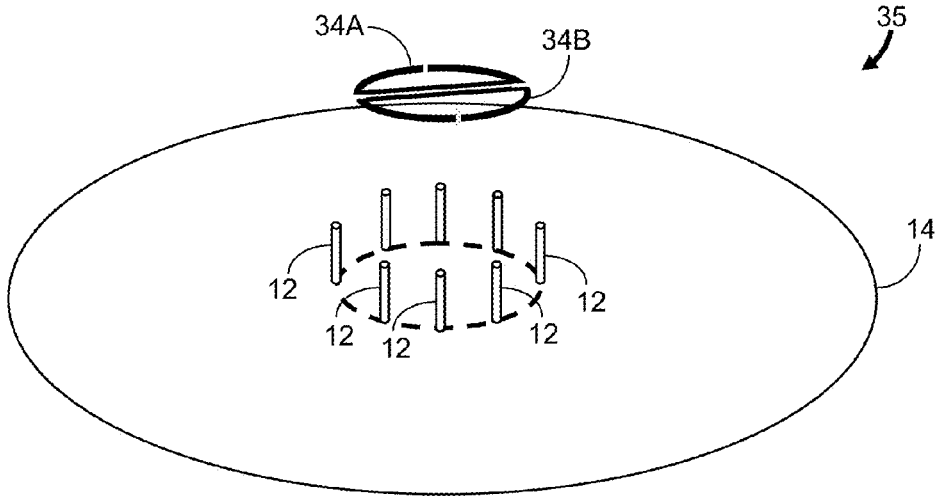
FIG. 6 is an illustration of another embodiment of a STAR antenna system according to the invention.
Figure 7:
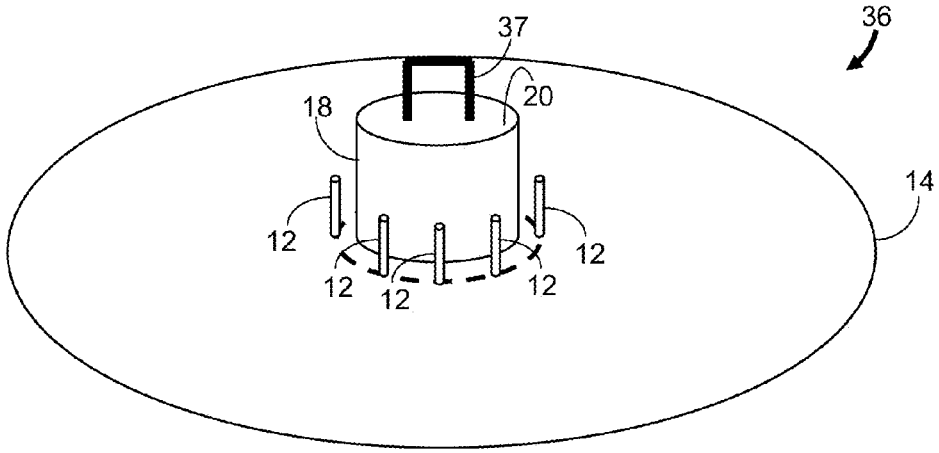
FIG. 7 is an illustration of another embodiment of a STAR antenna system according to the invention.

FIG. 5 shows another embodiment of a STAR antenna system 32 that includes a vertically polarized array of transmit monopole antenna elements 12 disposed over a circular ground plane 14 with a central receive horizontally-polarized omnidirectional loop antenna 34 over electrically conductive cylinder 18 and top ground plane 20. The loop antenna 34 is illustrated as an Alford loop antenna having two driven curved dipoles 34A and 34B in a ring configuration with an electrical circumference of approximately one wavelength. In other embodiments, other numbers of dipoles in a ring configuration can be used to approximate a uniform current loop. In some alternative configurations, a loop-fed slotted cylinder is used to generate an omnidirectional horizontal polarization. The combination loop and monopole antenna configuration of the system 32 yields increased isolation if the transmit monopole ring array is cross-polarized with respect to the receive loop antenna 34. FIG. 6 shows an embodiment of a STAR antenna system 35 that is similar to the system 32 of FIG. 5; however, the conductive cylinder 18 and top ground plane 20 are not present. Consequently, the transmit monopole antenna elements 12 have nearly omnidirectional azimuth radiation patterns. In some instances, it may be useful to provide direction finding capability for the receive antenna, in which case a directional antenna such as a vertically polarized loop 37 can be used as depicted in the STAR antenna system 36 of FIG. 7. In other embodiments, crossed vertically polarized loops and other directional antennas can be used.

Figure 8:
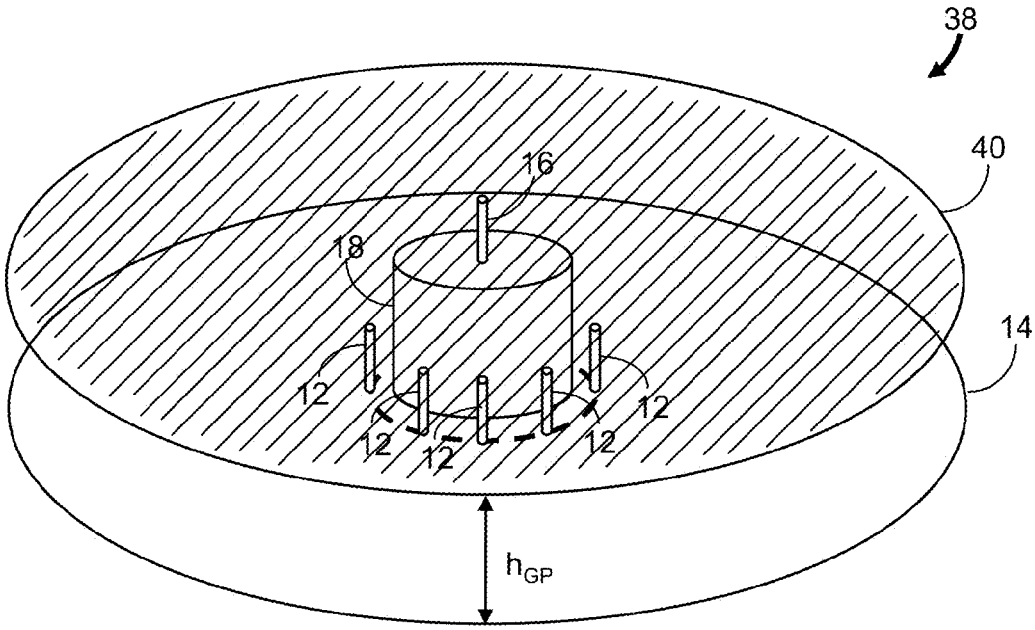
FIG. 8 is an illustration of another embodiment of a STAR antenna system according to the invention.

FIG. 8 shows another embodiment of a STAR antenna system 38 which includes a ring array of transmit monopole antenna elements 12 over a lower circular ground plane 14 and encircling a central electrically conductive cylinder 18. An upper circular ground plane 40 is disposed on top of the conductive cylinder 18 and beneath a central receive monopole antenna element 18. The spacing $h_{GP}$ between the lower and upper circular ground planes 14 and 40 is greater than one-quarter of a wavelength to provide sufficient space for the transmit monopole elements 12 and less than three-quarters of a wavelength to avoid higher order modes. The upper ground plane 40 increases the effective propagation distance between the transmit monopole elements 12 and the receive monopole element 16 to thereby increase transmit and receive isolation.

Figure 9:
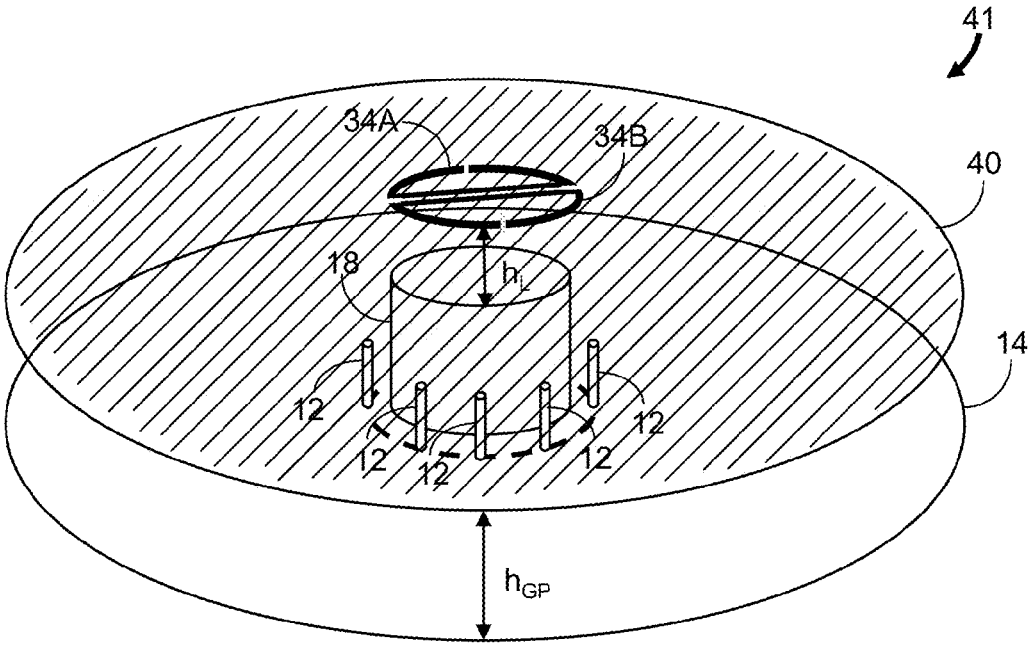
FIG. 9 is an illustration of another embodiment of a STAR antenna system according to the invention.
Figure 10:
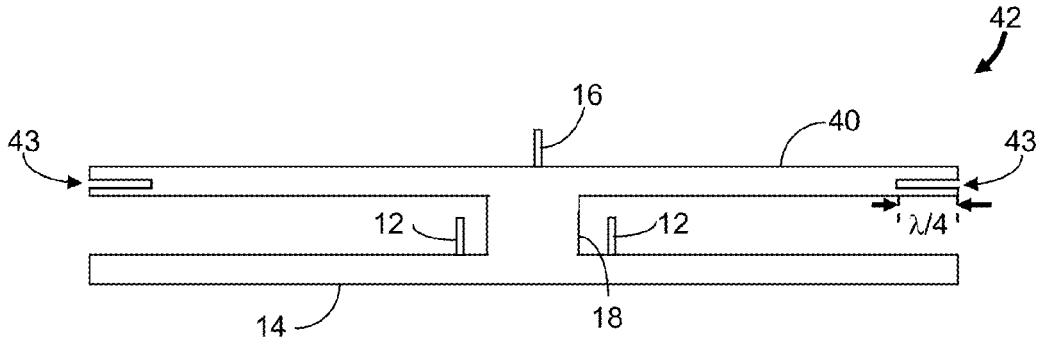
FIG. 10 is a side view of an embodiment of a STAR antenna system in which a slot is formed in a circumference of an upper ground plane.

In an alternative embodiment of a STAR antenna system 41 shown in FIG. 9, a central receive horizontally-polarized omnidirectional loop antenna 34 replaces the receive monopole element 16. In another embodiment, a slot 43 of one-quarter wavelength radial depth is formed in a circumference of the upper ground plane 40 of FIG. 8 to serve as a choke ring as shown in the side view of the STAR antenna system 42 of FIG. 10. The choke ring increases the isolation between the receive monopole 16 and the transmit monopoles 12. The one-quarter wavelength choke ring appears electrically as an open circuit at the center operating frequency and acts to restrict current flow and edge diffraction of the upper circular ground plane 40.

Figure 11:
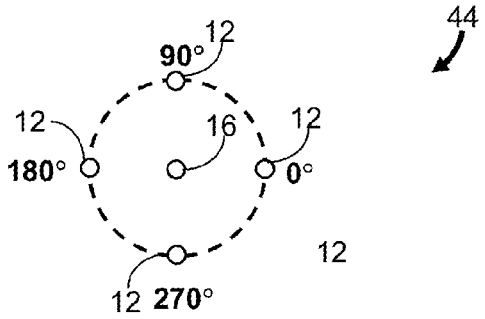
FIG. 11 is a schematic diagram of an embodiment of an omnidirectional STAR antenna system having a transmit ring array with four antenna elements where a phase shift between adjacent transmit elements is 90°.
Figure 12:
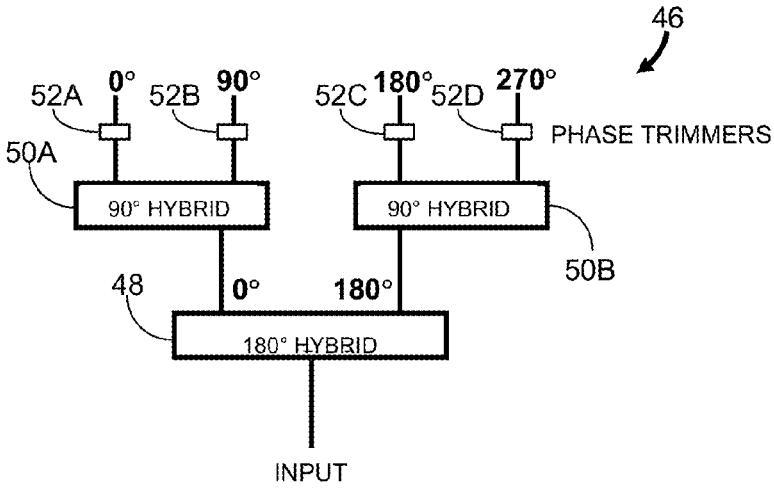
FIG. 12 is a block diagram of a beamformer that can be used with the STAR antenna system of FIG. 11.

FIG. 11 is a schematic diagram of an exemplary omnidirectional STAR antenna system 44 having a receive antenna element 16 and a transmit ring array with four antenna elements 12. The phase shift between adjacent transmit elements 12 is 90° and the phase increases with angle around the ring array so that a null occurs at the receive antenna element 16. FIG. 12 is a block diagram of a beamformer 46 that can be used with the system 44 of FIG. 11. A transmit signal is applied to the beamformer 46 at the INPUT port. The transmit signal is divided into two anti-phase transmit signals of equal amplitude by a 180° hybrid 48. Each of the two anti-phase signals are further divided by two 90° hybrids 50A and 50B into two equal amplitude transmit signals differing in phase by 90°. Each of the four resulting transmit signals is passed through a phase trimmer 52A, 52B, 52C and 52D to compensate for phase variations and phase errors that may be present due to differences in the hybrid elements 48 and 50 and phase error contributions due to the microwave cables and connectors. The beamformer 46 can be implemented using either analog or digital components.

Figure 13:
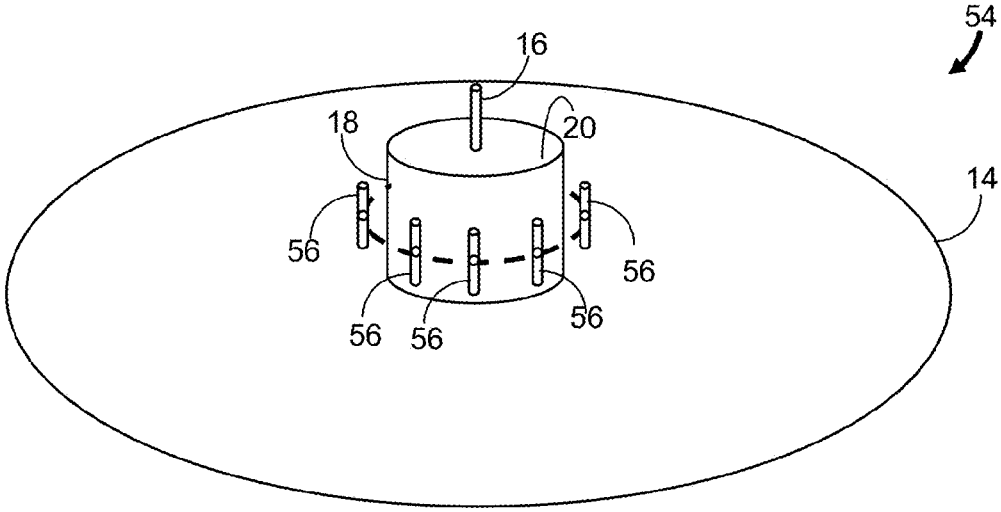
FIG. 13 is an illustration of another embodiment of a STAR antenna system according to the invention.
Figure 14:
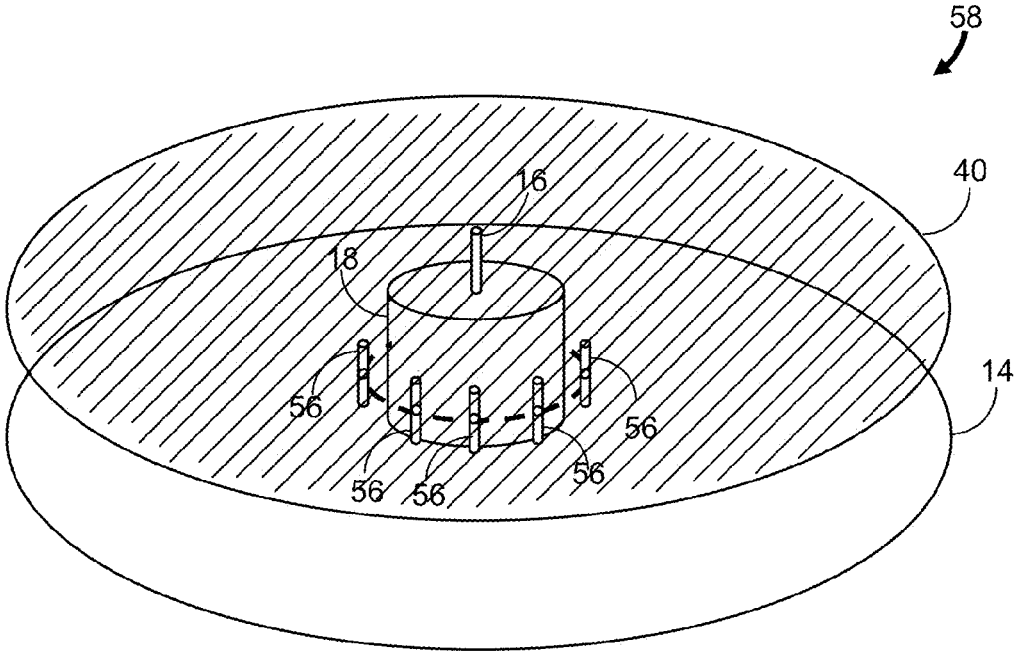
FIG. 14 is an illustration of another embodiment of a STAR antenna system according to the invention.
Figure 15:
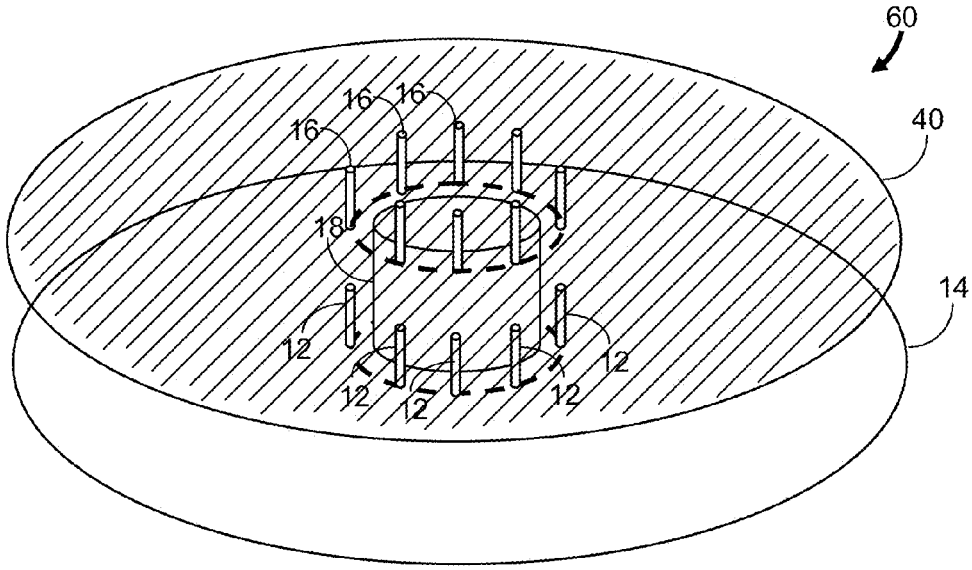
FIG. 15 is an illustration of another embodiment of a STAR antenna system according to the invention.

FIG. 13 shows an embodiment of a STAR antenna system 54 which includes a vertically-polarized ring array of transmit dipole antenna elements 56 over a lower circular ground plane 14. A central receive vertical monopole antenna 16 is disposed over a central electrically-conductive cylinder 18 and a top ground plane 20. FIG. 14 shows an alternative embodiment of a STAR antenna system 58 that is similar to the system 54 of FIG. 13 except that an upper circular ground plane 40 replaces the top ground plane 20 at the upper end of the conductive cylinder 18. FIG. 15 shows another embodiment of a STAR antenna system 60. The system 60 is similar to the system 58 of FIG. 14 except that the single receive monopole antenna 16 above the upper ground plane 40 is replaced with a centrally-positioned vertically-polarized omnidirectional receive ring array having a plurality of receive monopole antenna elements 16.

Figure 17:
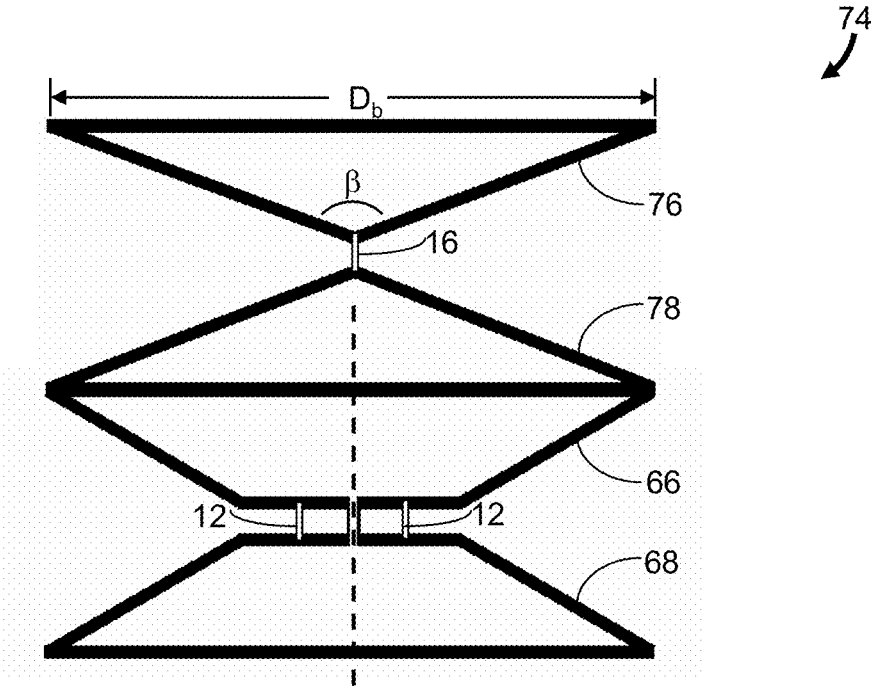
FIG. 17 is an illustration of an embodiment of a STAR antenna system that includes a wideband truncated biconical antenna for transmission and a receive biconical antenna.

Biconical antennas and conical monopoles are known to provide large bandwidths. For example, the ratio of the highest frequency to the lowest frequency can be 6:1 or more. Referring to FIG. 17, large bandwidths are achieved when the diameter $D_b$ of the biconical antenna is one wavelength at the lowest frequency and the flare angle $\beta$ is 120°.

Figure 16:
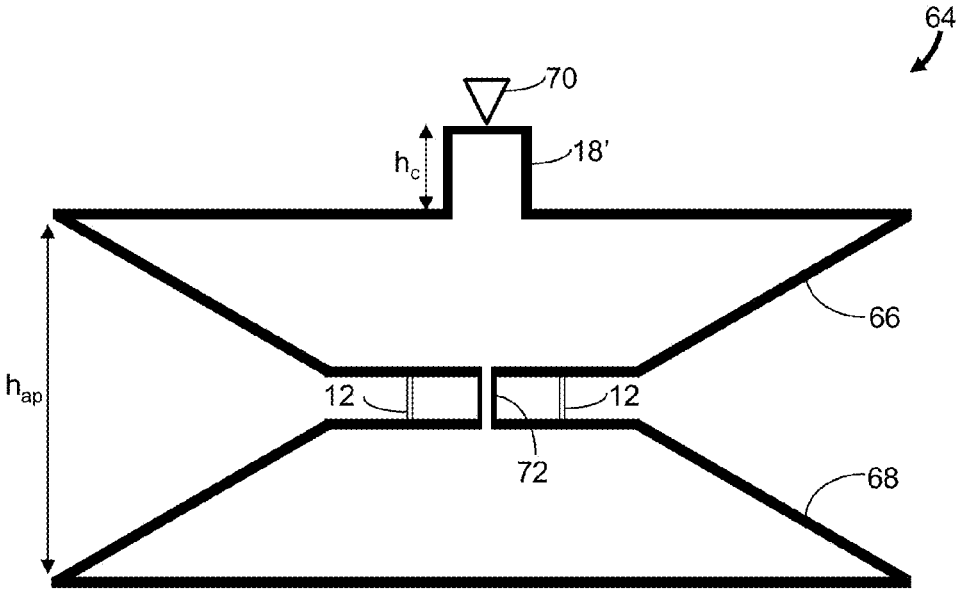
FIG. 16 is an illustration of an embodiment of a STAR antenna system configured as a wideband truncated biconical antenna.

FIG. 16 depicts an embodiment of a STAR antenna system 64 configured as a wideband truncated biconical antenna having an upper truncated conical section 66, a lower truncated conical section 68 and a vertically-polarized transmit ring array with antenna elements 12. The system 64 also includes a single vertically-polarized receive conical monopole antenna 70. The upper and lower truncated conical sections 66 and 68 are electrically-conductive. An electrically-conductive cylinder 18' is disposed between the conical monopole antenna 70 and the upper truncated conical section 66. The height $h_c$ of the conductive cylinder 18' is selected to provide the desired receive radiation pattern characteristics in elevation. The height $h_{ap}$ of the radiating aperture is selected to achieve a desired transmit elevation beamwidth. A metallic tube 72 provides a means for passing a coaxial cable through the truncated conical sections 66 and 68 to the receive conical monopole antenna 70. The metallic tube 72 does not significantly interfere with transmit operation because it is located at an approximate null of the electric field due to the relative phasing of the antenna elements 12 in the transmit ring array. By way of example, the STAR antenna system 64 may have an operating range that extends approximately from 0.8 GHz to 6.0 GHz.

FIG. 17 depicts another embodiment of a STAR antenna system 74. The system 74 includes a wideband truncated biconical antenna having an upper truncated conical section 66, a lower truncated conical section 68 and a vertically-polarized ring array with transmit monopole antenna elements 12. The system 74 also includes a vertically polarized receive symmetrical biconical antenna "stacked" on top of the truncated biconical antenna and having upper and lower conical sections 76 and 78, respectively, and a receive monopole antenna element 16. Preferably, the transmit and receive monopole elements 12 and 16, respectively, are fabricated by extending the center pin of a microwave connector. The upper end each transmit monopole element 12 is electrically coupled to the upper truncated conical section 66 and the upper end of the receive monopole antenna element 16 is electrically coupled to the upper conical section 76. In a preferred embodiment, the upper truncated conical section 66 and the lower conical section 78 are electrically and mechanically coupled to each other, for example, by bolts or other fasteners.

Measurement Data

Figure 18A:
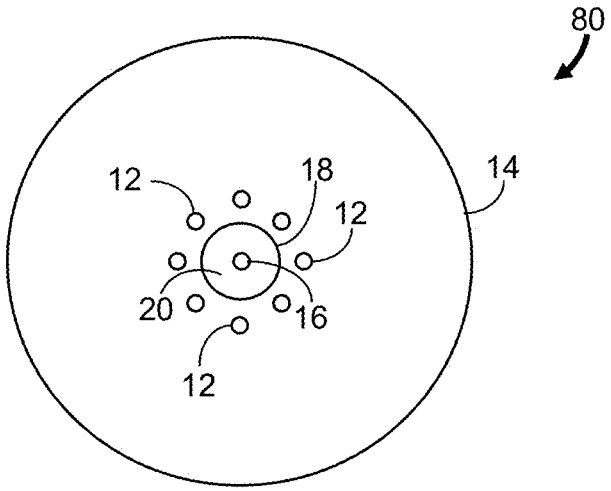
FIG. 18A is an illustration of a top view of a STAR antenna system fabricated to permit measurements to obtain system performance data.
Figure 18B:
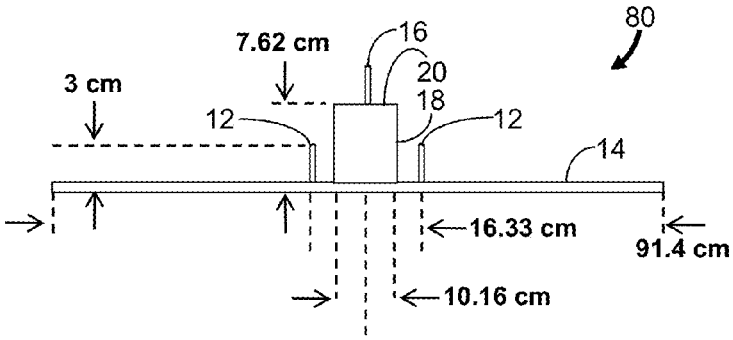
FIG. 18B is an illustration of a side view of the STAR antenna system of FIG. 18A.
Figure 19:
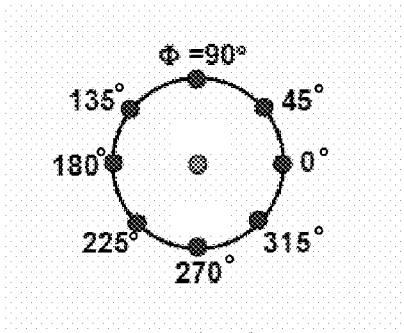
FIG. 19 is a graphical depiction of the relative phase for each of the transmit monopole elements 12 of FIG. 18A and FIG. 18B.

A STAR antenna system for the 2.4 to 2.5 GHz ISM band was fabricated and measurements obtained during operation in an anechoic chamber to obtain system performance data. FIG. 18A and FIG. 18B are illustrations of a top view and side view, respectively, of the fabricated system 80 which included a 91.4 cm diameter ground plane 14, eight transmit monopole antenna elements 12, and a single receive monopole element 16 centered above a conductive cylinder 18 and top ground plane 20. FIG. 19 depicts the relative phase for each of the transmit monopole elements 12. Design parameters for the STAR antenna system 80 are summarized in Table 1. The system 80 was fabricated to accommodate multiple configurations which included a configuration as described above with respect to FIG. 1 and a configuration in which an upper ground plane 40 is included as described above with respect to FIG. 6. The monopole antenna elements 12 and 16 were fabricated by extending the center pin length of a standard SMA coaxial connector (e.g., SMA coaxial connector model no. 1052978 available from Tyco Electronics Corporation of Berwyn, Pa.) which is attached to the bottom ground plane 14. The eight transmit monopole antenna elements 12 were fed with phase-matched coaxial cables for initial tests of return loss and gain radiation patterns. The far-field gain radiation patterns of each individual transmit monopole element 12 was measured with the other transmit monopole elements 12 terminated in 50-ohm resistive matched loads.

TABLE 1

| Parameter | Dimension (cm) |
|---|---|
| Transmit monopole element length | 3.048 (nominal) |
| Transmit monopole feed gap | 0.254 (nominal) |
| Transmit monopole element diameter | 0.3175 |
| Transmit monopole ring array diameter | 16.335 |
| Center conductive cylinder diameter | 10.16 |
| Center conductive cylinder height | 7.62 |
| Lower ground plane diameter | 91.44 |
| Lower ground plane thickness | 0.635 |
| Receive monopole element length | 3.048 (nominal) |
| Receive monopole feed gap | 0.254 (nominal) |
| Receive monopole element diameter | 0.3175 |

To synthesize the desired null at the receive monopole element 16, the transmit ring array was fed with a beamformer that included four Anaren Model No. 30056 180° hybrids and an Anaren Model 40276 4-way combiner (available from Anaren Microwave, Inc. of East Syracuse, N.Y.), and coaxial phase trimmers to achieve the phase progression shown in FIG. 19. The reflection coefficient (return loss), gain loss (mismatch loss), and mutual coupling S-parameters were measured using a network analyzer.

Figure 20:
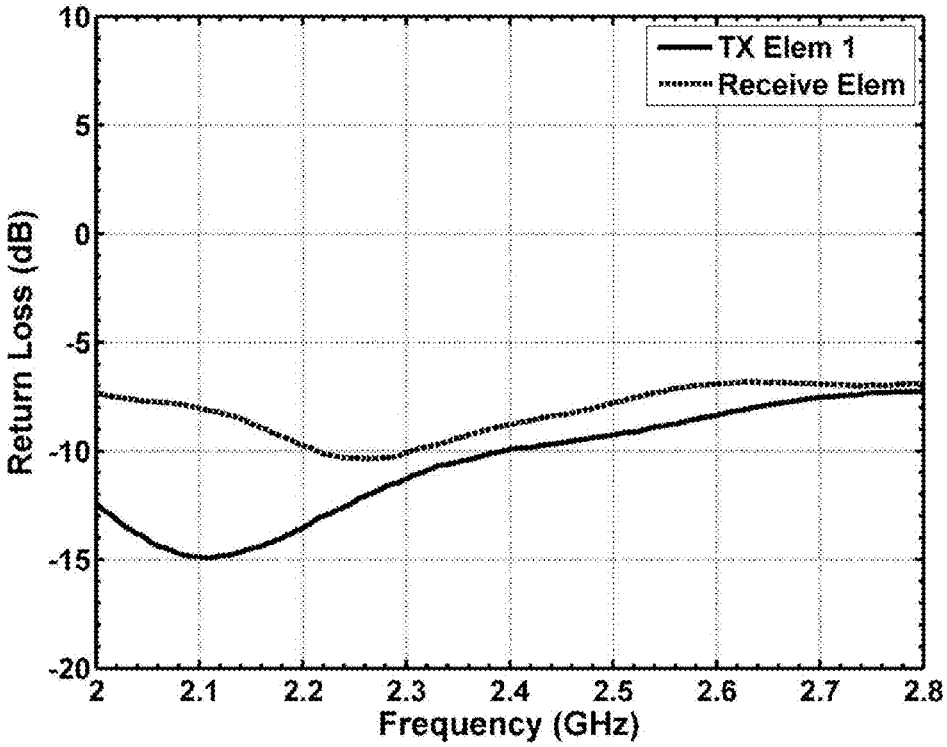
FIG. 20 shows the measured return loss for the STAR antenna system of FIG. 18A and FIG. 18B.
Figure 21:
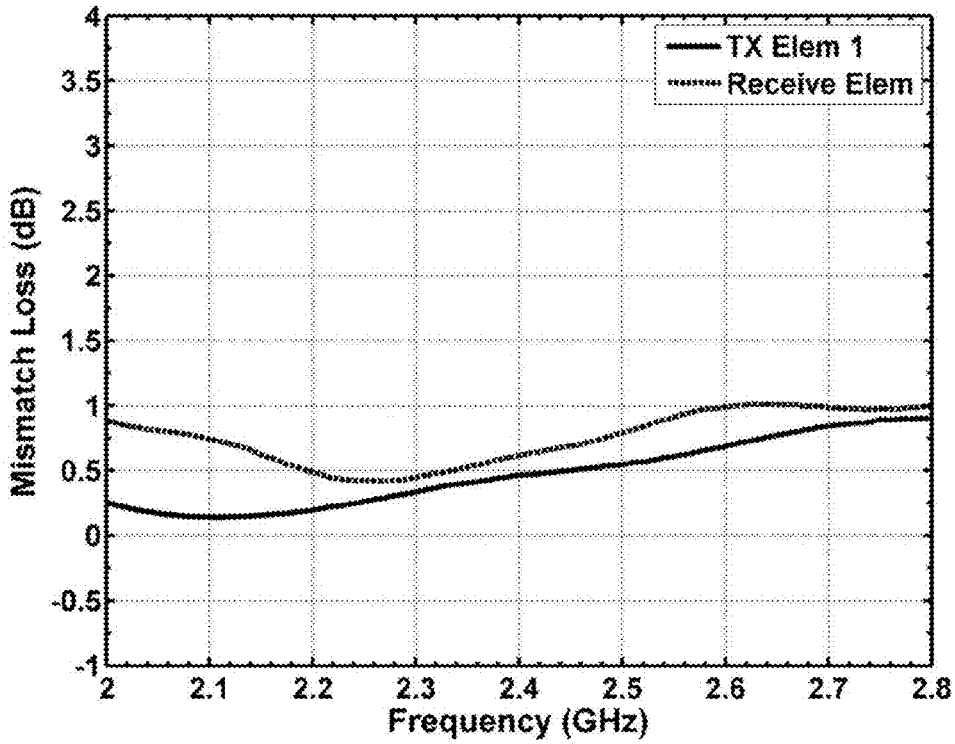
FIG. 21 shows the corresponding mismatch loss corresponding to the measured return loss of FIG. 20 for the central receive monopole element and one of the transmit monopole elements for the STAR antenna system of FIG. 18A and FIG. 18B.

FIG. 20 shows the measured return loss (reflection coefficient in dB) and FIG. 21 shows the corresponding mismatch loss (computed from the measured return loss as $10 \log_{10}(1-|R|^2)$) for the central receive monopole element 16 and one of the transmit monopole elements (element 1) for the STAR antenna system 80 of FIGS. 18A and 18B. The measured mismatch loss is less than 1 dB for both the transmit monopole 12 and receive monopole 16.

Figure 22:
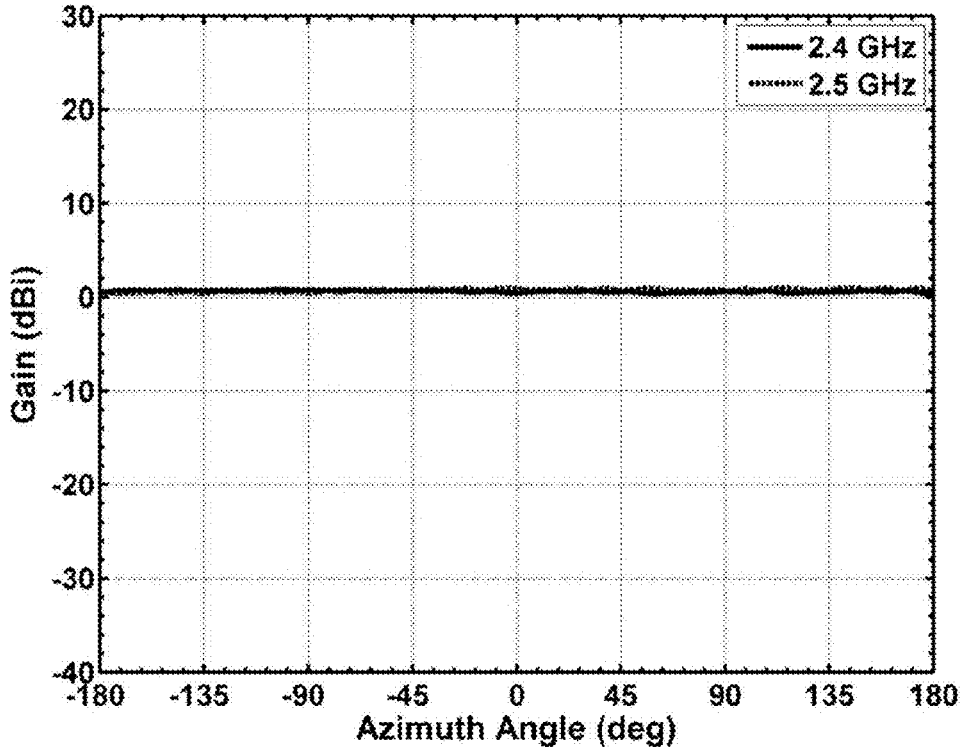
FIG. 22 shows the measured vertically-polarized azimuth gain patterns for the central receive monopole of the STAR antenna system of FIG. 18A and FIG. 18B at 2.4 GHz and 2.5 GHz.

FIG. 22 shows the measured vertically-polarized azimuth gain patterns for the central receive monopole 16 at 2.4 GHz and 2.5 GHz. In these measurements, the azimuth angle was varied from −180° to 180° and the elevation angle was fixed at 0° (horizon). The surrounding transmit monopole elements 12 were terminated in 50-ohm resistive loads. The data demonstrate that omnidirectional gain coverage is achieved. The measured average azimuth gain level is constant at approximately 0.5 dBi across the frequency band.

Figure 23:
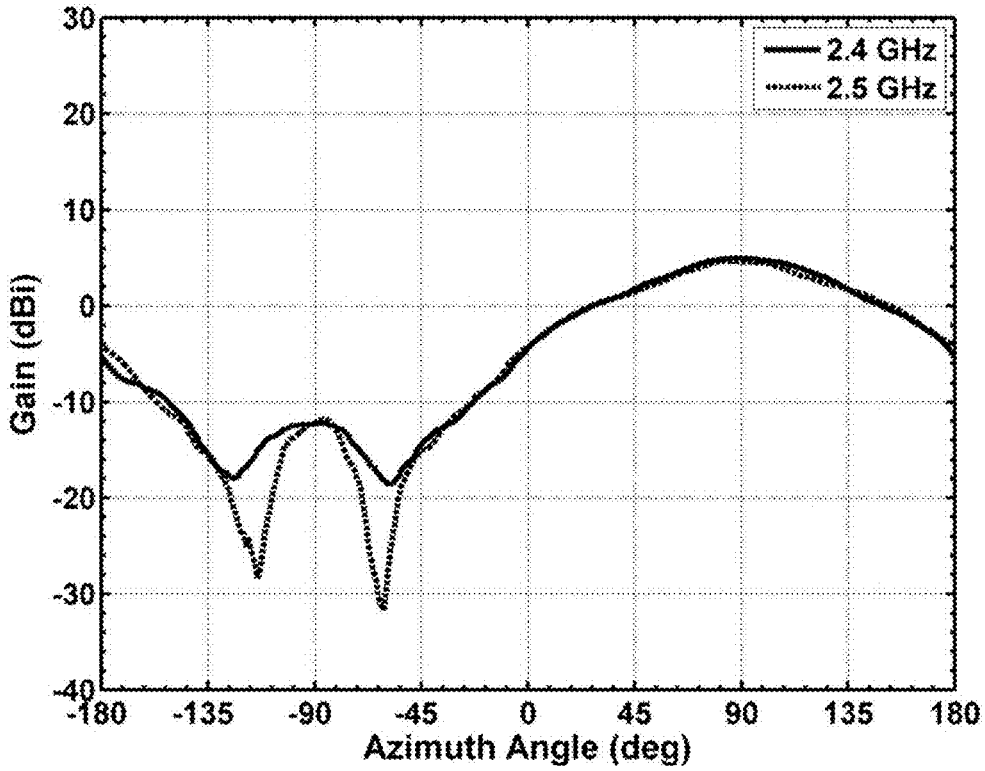
FIG. 23 shows the measured vertically-polarized azimuth gain patterns at 2.4 GHz and 2.5 GHz band for a transmit monopole element in the STAR antenna system of FIG. 18A and FIG. 18B.

FIG. 23 shows the measured vertically-polarized azimuth gain patterns at 2.4 GHz and 2.5 GHz band for transmit monopole element number 3 in the eight element ring array. The other transmit monopole elements 12 were terminated in 50-ohm resistive loads. Transmit monopole element 3 is located at a 90° azimuth angle. A measured peak gain of approximately 5 dBi occurs, as expected, at 90° azimuth and the azimuth half-power beamwidth is approximately 87°.

Figure 24:
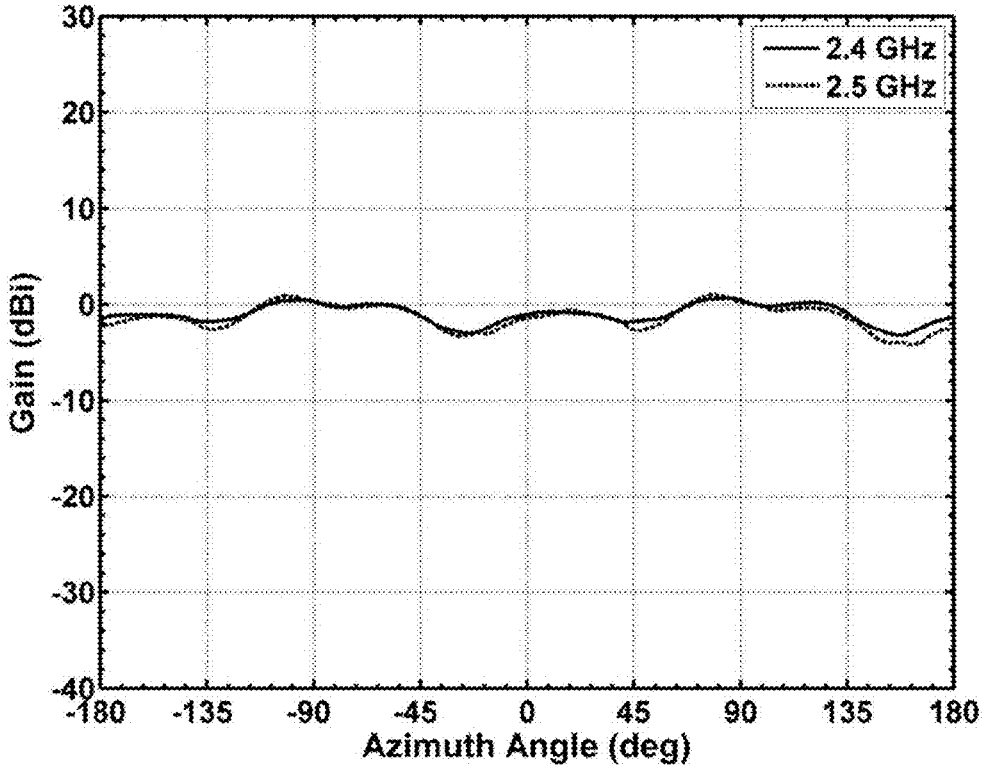
FIG. 24 shows the measured vertically-polarized azimuth gain patterns at 2.4 GHz and 2.5 GHz for the STAR antenna system of FIG. 18A and FIG. 18B.
Figure 25:
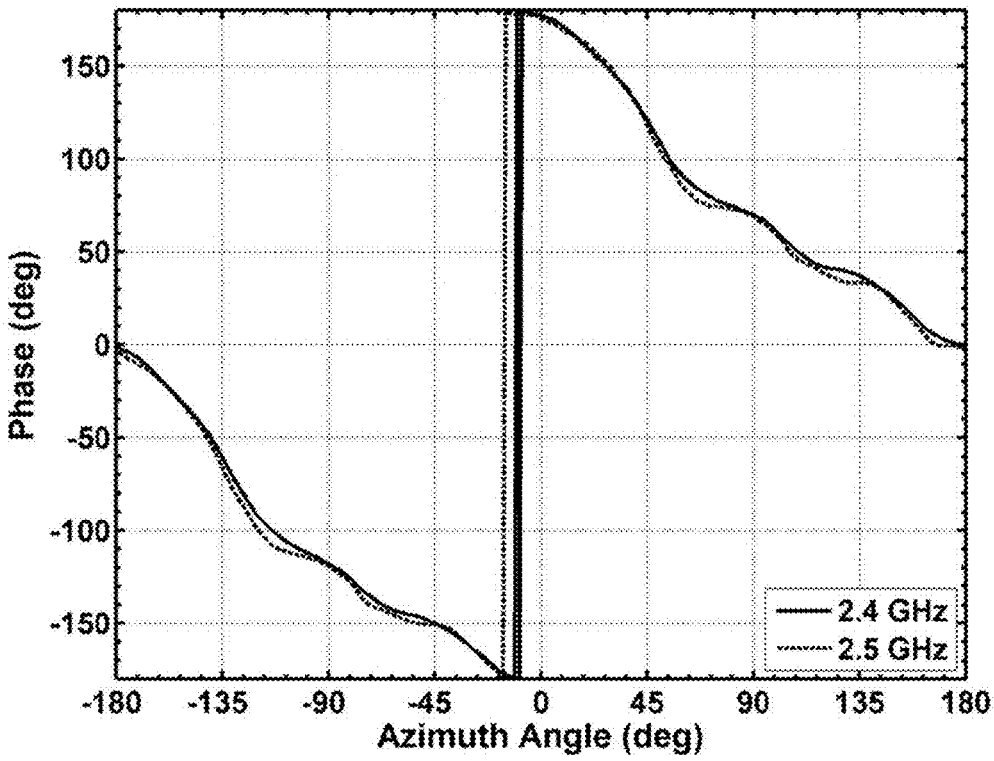
FIG. 25 shows the measured vertically-polarized azimuth phase patterns at 2.4 GHz and at 2.5 GHz for the STAR antenna system of FIG. 18A and FIG. 18B.

FIG. 24 shows the measured vertically-polarized azimuth gain patterns at 2.4 GHz and 2.5 GHz for the STAR antenna system 80 with the linear progressive phase distribution according to FIG. 19. The central monopole receive element 16 was terminated in a 50-ohm resistive load during the measurements. The gain patterns exhibit substantially omnidirectional performance. FIG. 25 shows the corresponding measured vertically-polarized azimuth phase patterns at 2.4 GHz and at 2.5 GHz. As expected, the phase is seen to cycle in a substantially linear manner through 360° in azimuth.

Figure 26:
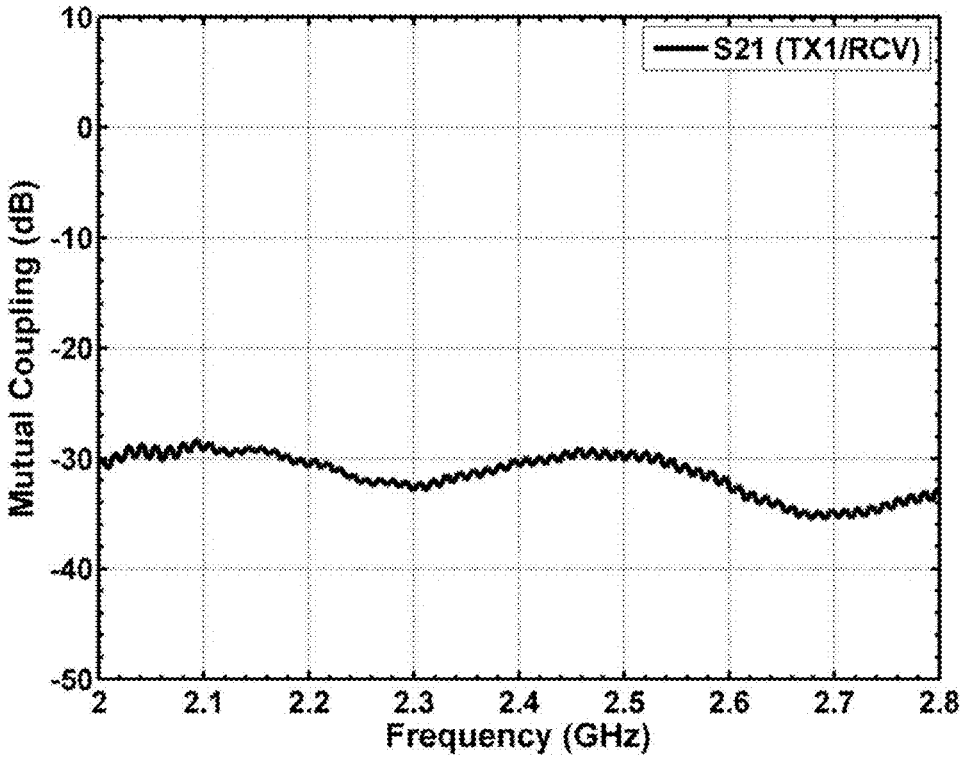
FIG. 26 shows the magnitude of the measured mutual coupling between the central receive monopole and one of the transmit monopole elements for the STAR antenna system of FIG. 18A and FIG. 18B.

The measured mutual coupling (S21) magnitude between the central receive monopole 16 and transmit monopole element 1 for the STAR antenna system 80 is shown in FIG. 26. The measured isolation is at approximately −30 dB in the 2.4 to 2.5 GHz band.

Figure 27:
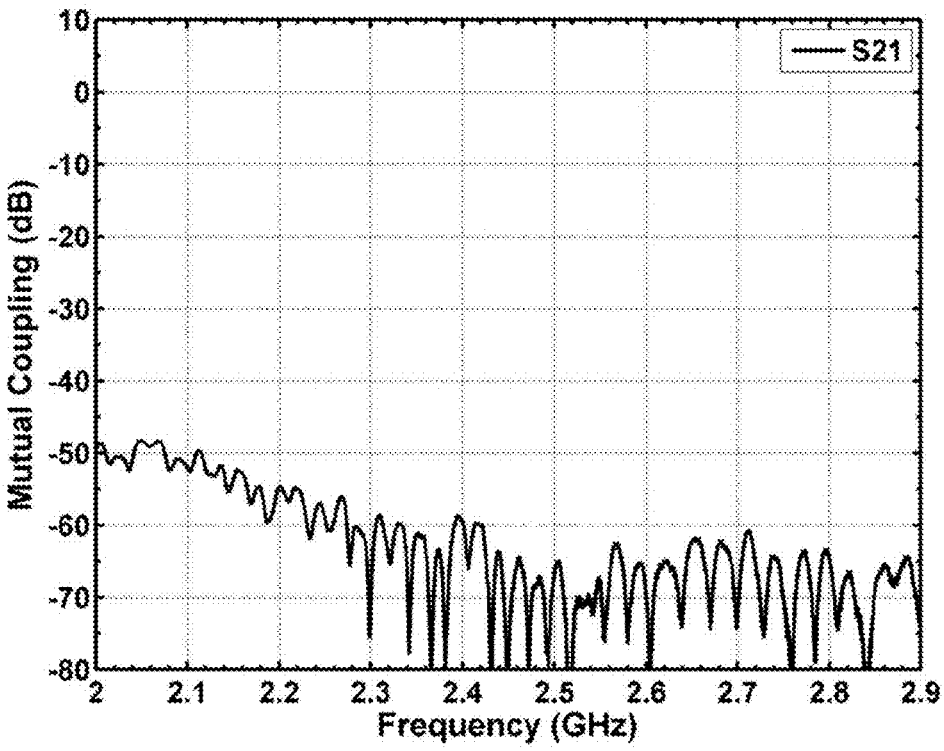
FIG. 27 shows the magnitude of the measured mutual coupling for eight active transmit monopole elements for the STAR antenna system of FIG. 18A and FIG. 18B.

FIG. 27 shows the measured mutual coupling magnitude for the eight active transmit monopole elements 12 operating with linearly progressive phase in azimuth. Greater than 60 dB isolation is demonstrated over the 2.4 to 2.5 GHz band.

Figure 28:
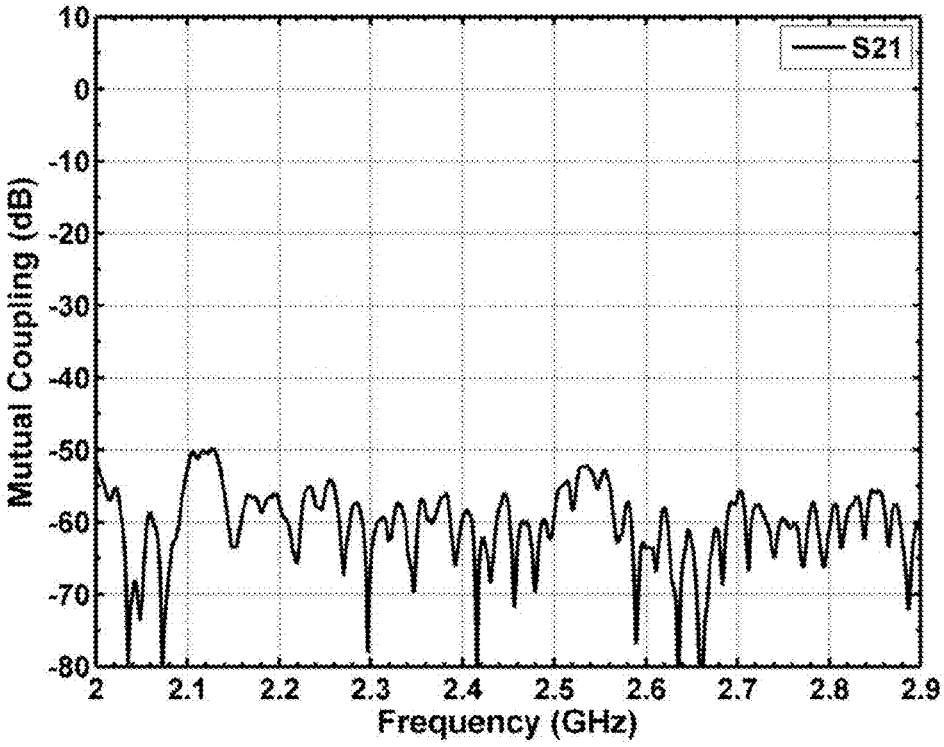
FIG. 28 shows the magnitude of the mutual coupling for eight active transmit monopole elements for another embodiment of a STAR antenna system.

A STAR antenna system having a 21.3 cm diameter ground plane and design parameters summarized in Table 2 was also fabricated and measured. The mutual coupling magnitude for eight active transmit monopole elements 12 and linearly progressive phase in azimuth is shown in FIG. 28. Isolation greater than 56 dB is demonstrated over the 2.4 to 2.5 GHz band.

TABLE 2

| Parameter | Dimension (cm) |
|---|---|
| Transmit monopole element length | 3.048 (nominal) |
| Transmit monopole feed gap | 0.254 (nominal) |
| Transmit monopole element diameter | 0.3175 |
| Transmit monopole ring array diameter | 15.667 |
| Center conductive cylinder diameter | 9.672 |
| Center conductive cylinder height | 7.315 |
| Lower ground plane diameter | 21.234 |
| Lower ground plane thickness | 0.635 |
| Receive monopole element length | 3.0 (nominal) |

TABLE 2-continued

| Parameter | Dimension (cm) |
|---|---|
| Receive monopole feed gap | 0.254 (nominal) |
| Receive monopole element diameter | 0.3175 |

While the invention has been shown and described with reference to specific embodiments, it should be understood by those skilled in the art that various changes in form and detail may be made therein without departing from the spirit and scope of the invention. For instance, various embodiments described above describe particular configurations of transmit antenna elements and receive antenna elements. It will be understood that reciprocal configurations of these embodiments are contemplated in which the transmit antenna elements are instead receive antenna elements and the receive antenna elements are instead transmit antenna elements. Moreover, STAR antenna systems based on the principles set forth above may also include wide bandwidth systems using electrically thick tubular monopoles or dipoles, Vivaldi flared notch radiators, log-periodic antennas, spiral antennas, helical antennas, waveguide antennas and other wideband radiators. Although described above with respect to certain frequencies and frequency bands, it will be appreciated that the STAR antenna systems described herein are suitable generally for a wide variety of applications from low RF frequencies to high microwave frequencies.

What is claimed is:

1. A simultaneous transmit and receive (STAR) antenna system, comprising:

a ring array of transmit antenna elements equally angularly distributed about a ring axis, each of the transmit antenna elements having a phase relative to the phase of the other transmit antenna elements wherein the phases increase linearly according to an angular position in the ring array and wherein the phases for an opposite pair of transmit antenna elements differ by 180 degrees;

a ground plane disposed under the ring array of transmit antenna elements;

an electrically-conductive cylinder disposed on the ring axis above the ground plane;

a top ground plane disposed at an end of the electrically-conductive cylinder opposite the ground plane; and a receive antenna element disposed on the ring axis above the electrically-conductive cylinder and top ground plane, wherein a path between each transmit antenna element and the receive antenna element is at least partially obscured by at least one of the electrically-conductive cylinder and the top ground plane to thereby increase isolation between the transmit antenna elements and the receive antenna element.

2. The STAR antenna system of claim 1 wherein the transmit antenna elements and the receive antenna element are monopole antenna elements.

3. The STAR antenna system of claim 1 wherein the transmit antenna elements and the receive antenna element are vertically-polarized antenna elements.

4. The STAR antenna system of claim 1 wherein a spacing between a pair of neighboring transmit antenna elements is approximately one-half wavelength at a center operating frequency.

5. The STAR antenna system of claim 1 wherein each of the transmit antenna elements is spaced from the electrically-conductive cylinder by a distance of one-quarter wavelength of the center operating frequency.

6. The STAR antenna system of claim 1 wherein the receive antenna element is a horizontally-polarized omnidirectional loop antenna.

7. The STAR antenna system of claim 1 wherein the receive antenna element is a vertically polarized loop antenna element.

8. The STAR antenna system of claim 1 wherein the top ground plane is circular and has a diameter that is equal to a diameter of the electrically-conductive cylinder.

9. The STAR antenna system of claim 1 wherein the ground plane and the top ground plane are circular and each has a diameter that is greater than a diameter of the electrically-conductive cylinder.

10. The STAR antenna system of claim 9 wherein the top ground plane has a choke ring formed as a slot in a circumference of the top ground plane.

11. The STAR antenna system of claim 1 wherein the transmit antenna elements are dipole antenna elements.

12. The STAR antenna system of claim 1 wherein the transmit antenna elements and the receive antenna element are configured for operation in a frequency range of approximately 2.4 GHz to 2.5 GHz.

13. The STAR antenna system of claim 1 wherein each of the transmit antenna elements is electrically-coupled to the ground plane by a coaxial connector and wherein the receive antenna element is electrically-coupled to the top ground plane by a coaxial connector.

14. The STAR antenna system of claim 1 wherein the transmit and receive antenna elements are configured for wireless full duplex communications.

15. The STAR antenna system of claim 14 wherein the transmit and receive antenna elements operate according to one of WIFI IEEE standard 802.11 and WIMAX IEEE standard 802.16.

16. A simultaneous transmit and receive (STAR) antenna system, comprising:

a ring array of transmit antenna elements equally angularly distributed about a ring axis, each of the transmit antenna elements having a phase relative to the phase of the other transmit antenna elements wherein the phases increase linearly according to an angular position in the ring array and wherein the phases for an opposite pair of transmit antenna elements differ by 180 degrees;

a ground plane disposed under the ring array of transmit antenna elements; and a receive antenna element disposed on the ring axis above the ring array.

17. The STAR antenna system of claim 16 wherein the receive antenna element is a horizontally-polarized omnidirectional loop antenna.

18. A simultaneous transmit and receive (STAR) antenna system, comprising:

a ring array of transmit antenna elements equally angularly distributed about a ring axis, each of the transmit antenna elements having a phase relative to the phase of the other transmit antenna elements wherein the phases increase linearly according to an angular position in the ring array of transmit antenna elements and wherein the phases for an opposite pair of transmit antenna elements differ by 180 degrees;

a first ground plane disposed under the ring array of transmit antenna elements;

an electrically-conductive cylinder disposed on the ring axis above the first ground plane;

a second ground plane disposed at an end of the electrically-conductive cylinder opposite the first ground plane; and a ring array of receive antenna elements equally angularly distributed about the ring axis and disposed above the second ground plane, each of the receive antenna elements having a phase relative to the phase of the other receive antenna elements wherein the phases increase linearly according to an angular position in the ring array of receive antenna elements and wherein the phases for an opposite pair of receive antenna elements differ by 180 degrees.

19. The STAR antenna system of claim 18 wherein the transmit antenna elements and the receive antenna elements are monopole antenna elements.

20. A simultaneous transmit and receive (STAR) antenna system, comprising:

an upper truncated conical section having an electrically-conductive surface;

a lower truncated conical section having an electrically-conductive surface;

a ring array of transmit antenna elements equally angularly distributed about a ring axis and disposed between the upper and lower truncated conical sections, each of the transmit antenna elements having a phase relative to the phase of the other transmit antenna elements wherein the phases increase linearly according to an angular position in the ring array and wherein the phases for an opposite pair of transmit antenna elements differ by 180 degrees;

an electrically-conductive cylinder disposed above the upper truncated conical section;

a top ground plane disposed at an end of the electrically-conductive cylinder opposite the upper truncated conical section; and a conical receive antenna element disposed on the ring axis above the top ground plane.

21. The STAR antenna system of claim 20 wherein the conical receive antenna element and each of the transmit antenna elements is a monopole antenna element.

22. The STAR antenna system of claim 20 wherein each of the transmit antenna elements is electrically-coupled to the upper truncated conical section.

23. The STAR antenna system of claim 22 wherein each of the transmit antenna elements is electrically-coupled to the upper truncated conical section by a coaxial connector.

24. A simultaneous transmit and receive (STAR) antenna system, comprising:

an upper truncated conical section having an electrically-conductive surface;

a lower truncated conical section having an electrically-conductive surface;

a ring array of transmit antenna elements equally angularly distributed about a ring axis and disposed between the upper and lower truncated conical sections, each of the transmit antenna elements having a phase relative to the phase of the other transmit antenna elements wherein the phases increase linearly according to an angular position in the ring array and wherein the phases for an opposite pair of transmit antenna elements differ by 180 degrees;

a lower conical section having an electrically-conductive surface and being disposed above the upper truncated conical section;

an upper conical section having an electrically-conductive surface and being disposed above the lower conical section; and a receive antenna element disposed between the lower and upper conical sections.

25. The STAR antenna system of claim 24 wherein the receive antenna element and each of the transmit antenna elements is a monopole antenna element.

26. The STAR antenna system of claim 24 wherein each of the transmit antenna elements is electrically-coupled to the upper truncated conical section.

27. The STAR antenna system of claim 26 wherein each of the transmit antenna elements is electrically-coupled to the upper truncated conical section by a coaxial connector.

28. The STAR antenna system of claim 24 wherein the transmit and receive antenna elements are configured for wireless full duplex communications.

29. The STAR antenna system of claim 28 wherein the transmit and receive antenna elements operate according to one of WIFI IEEE standard 802.11 and WIMAX IEEE standard 802.16.

30. A simultaneous transmit and receive (STAR) antenna system, comprising:

a ring array of receive antenna elements equally angularly distributed about a ring axis, each of the receive antenna elements having a phase relative to the phase of the other receive antenna elements wherein the phases increase linearly according to an angular position in the ring array and wherein the phases for an opposite pair of receive antenna elements differ by 180 degrees;

a ground plane disposed under the ring array of receive antenna elements;

an electrically-conductive cylinder disposed on the ring axis above the ground plane;

a top ground plane disposed at an end of the electrically-conductive cylinder opposite the ground plane; and a transmit antenna element disposed on the ring axis above the electrically-conductive cylinder and top ground plane, wherein a path between each receive antenna element and the transmit antenna element is at least partially obscured by at least one of the electrically-conductive cylinder and the top ground plane to thereby increase isolation between the receive antenna elements and the transmit antenna element.

31. A simultaneous transmit and receive (STAR) antenna system, comprising:

a ring array of receive antenna elements equally angularly distributed about a ring axis, each of the receive antenna elements having a phase relative to the phase of the other receive antenna elements wherein the phases increase linearly according to an angular position in the ring array and wherein the phases for an opposite pair of receive antenna elements differ by 180 degrees;

a ground plane disposed under the ring array of receive antenna elements; and a transmit antenna element disposed on the ring axis above the ring array.

32. A simultaneous transmit and receive (STAR) antenna system, comprising:

a ring array of receive antenna elements equally angularly distributed about a ring axis, each of the receive antenna elements having a phase relative to the phase of the other receive antenna elements wherein the phases increase linearly according to an angular position in the ring array of receive antenna elements and wherein the phases for an opposite pair of receive antenna elements differ by 180 degrees;

a first ground plane disposed under the ring array of receive antenna elements;

an electrically-conductive cylinder disposed on the ring axis above the ground plane;

a second ground plane disposed at an end of the electrically-conductive cylinder opposite the first ground plane; and a ring array of transmit antenna elements equally angularly distributed about the ring axis and disposed above the second ground plane, each of the transmit antenna elements having a phase relative to the phase of the other transmit antenna elements wherein the phases increase linearly according to an angular position in the ring array of transmit antenna elements and wherein the phases for an opposite pair of transmit antenna elements differ by 180 degrees.

33. A simultaneous transmit and receive (STAR) antenna system, comprising:

an upper truncated conical section having an electrically-conductive surface;

a lower truncated conical section having an electrically-conductive surface;

a ring array of receive antenna elements equally angularly distributed about a ring axis and disposed between the upper and lower truncated conical sections, each of the receive antenna elements having a phase relative to the phase of the other receive antenna elements wherein the phases increase linearly according to an angular position in the ring array and wherein the phases for an opposite pair of receive antenna elements differ by 180 degrees;

an electrically-conductive cylinder disposed above the upper truncated conical section;

a top ground plane disposed at an end of the electrically-conductive cylinder opposite the upper truncated conical section; and a conical transmit antenna element disposed on the ring axis above the top ground plane.

34. A simultaneous transmit and receive (STAR) antenna system, comprising:

an upper truncated conical section having an electrically-conductive surface;

a lower truncated conical section having an electrically-conductive surface;

a ring array of receive antenna elements equally angularly distributed about a ring axis and disposed between the upper and lower truncated conical sections, each of the receive antenna elements having a phase relative to the phase of the other receive antenna elements wherein the phases increase linearly according to an angular position in the ring array and wherein the phases for an opposite pair of receive antenna elements differ by 180 degrees;

a lower conical section having an electrically-conductive surface and being disposed above the upper truncated conical section;

an upper conical section having an electrically-conductive surface and being disposed above the lower conical section; and a transmit antenna element disposed between the lower and upper conical sections.

* * * * *